US005487245A

United States Patent [19]

Dazo et al.

[11] Patent Number: 5,487,245

[45] Date of Patent: Jan. 30, 1996

[54] PANELLED LIGHT TRANSMISSIVE MEMBER

[75] Inventors: Jeanette Dazo, Greenville; Hermon G. Reiber, Commerce; Richard Knighton, Carrollton; Spurgeon T. Peaden, Rockwall, all of Tex.

[73] Assignee: Wing Industries, Inc., Dallas, Tex.

[21] Appl. No.: 198,865

[22] Filed: Feb. 18, 1994

[51] Int. Cl.[6] ..... F06B 3/68

[52] U.S. Cl. ..... 52/204.61; 52/204.591; 52/456

[58] Field of Search ..... 52/314, 456, 204.59, 52/204.61, 204.62, 204.63, 204.7, 204.59, 455; 403/298; 411/510, 451, 455, 456

[56] References Cited

U.S. PATENT DOCUMENTS

| | | | |
|---|---|---|---|
| 190,225 | 5/1877 | Landeker . | |
| 479,433 | 7/1892 | Lee . | |
| 676,122 | 6/1901 | Byrnes | 52/204.59 |
| 1,012,015 | 12/1911 | Riodell et al. | 52/456 |
| 2,570,519 | 10/1951 | Burgess . | |
| 3,308,593 | 3/1967 | Smith | 52/204.61 |
| 3,372,522 | 3/1968 | Engstrom . | |
| 3,504,468 | 4/1970 | Martin | 52/456 |
| 3,678,651 | 7/1972 | Hicks . | |
| 4,454,699 | 6/1984 | Strobl | 403/298 |
| 4,610,901 | 9/1986 | Linscott . | |
| 4,681,477 | 7/1987 | Fischer | 403/298 |
| 4,807,419 | 2/1989 | Hodek et al. | 52/788 |
| 4,845,911 | 7/1989 | Winston . | |
| 5,077,950 | 1/1992 | Bretches et al. | 52/314 |
| 5,088,255 | 2/1992 | Emanuel . | |

*Primary Examiner*—Michael Safavi
*Attorney, Agent, or Firm*—Harold Levine

[57] ABSTRACT

A door/window construction in which a unitary sheet of light transmissive material such as transparent or translucent glass or plastic is covered with masking material and provided with a plurality of small holes spaced apart at predetermined intervals. Fasteners are inserted in the holes and project outwardly to engage corresponding recesses in muntins that are thereby positioned and fastened on the sheet so as to give the appearance of a multi-panelled door/window. Fastening staples are provided to hold exposed portions of the muntins in place when stiles and rails of the doors/windows are attached. Also included is the method of manufacture and assembly of the doors/windows.

24 Claims, 4 Drawing Sheets

FIG. 1
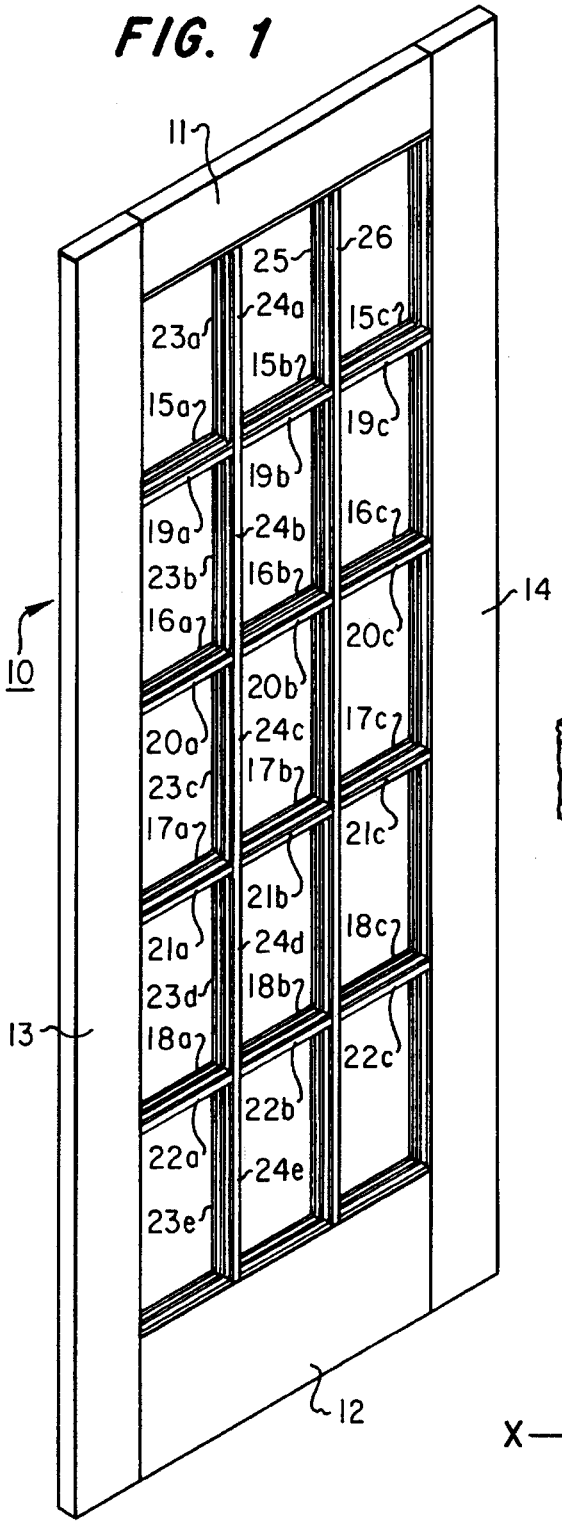
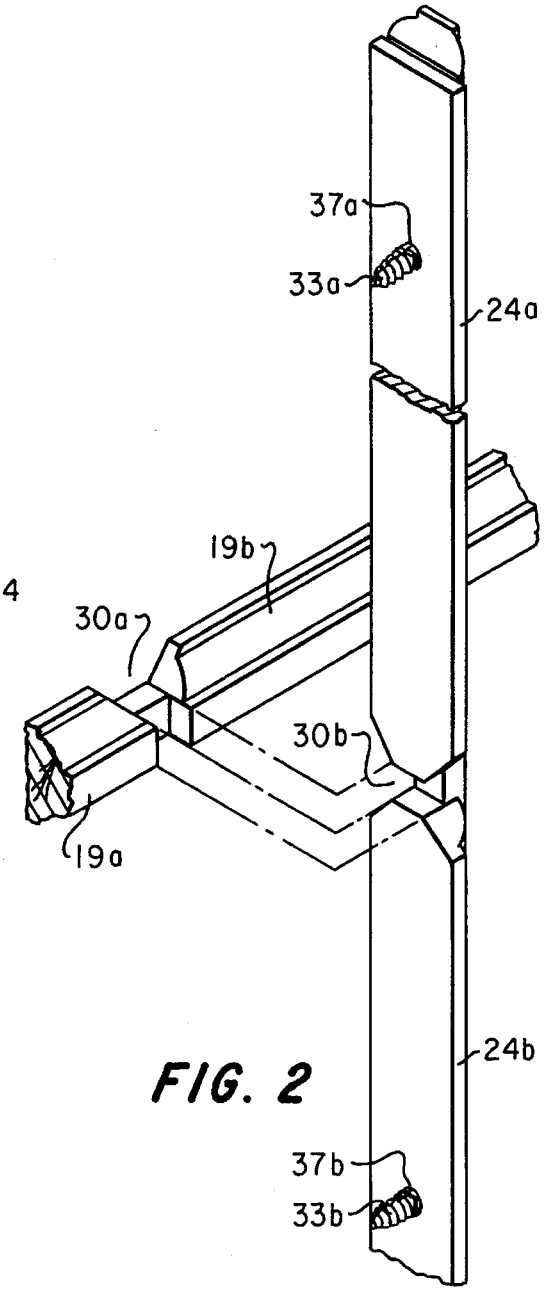
FIG. 2
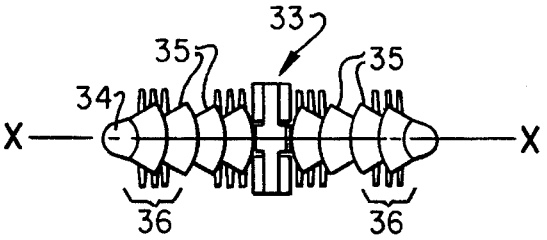
FIG. 3

PANELLED LIGHT TRANSMISSIVE MEMBER

This invention relates to light transmissive doors and windows and more particularly to such that have a plurality of panels outlined by a corresponding plurality of muntins.

BACKGROUND OF THE INVENTION

Panelled glass doors and windows have found widespread use because of their see-through character, their usefulness in passing light and because they are aesthetically appealing. Originally, such doors and windows took the form of main frames with criss-crossing mullions for producing a plurality of openings into which individual panes of glass were fitted. Illustrative of such construction is that described in U.S. Pat. No. 190,225 granted to L Landeker on May 1, 1877. A more recent example is that of U.S. Pat. No. 4,845,911 granted to Winston et al. Jul. 11, 1989. In addition to such examples, a variety of other proposals have been made to improve facility of production and of pane replacement.

In addition to the foregoing, proposals have been made for adding false muntins to a windowpane so as seemingly to divide such pane into at least two lights. Illustrative of such proposal is that set forth in U.S. Pat. No. 3,678,651 granted to Glen Hicks on Jul. 25, 1972.

While the proposals of the prior art have produced seeming divisions of a glass light into sub-divisions, they have been relatively complex, relatively costly to manufacture, and relatively difficult to repair. Accordingly, there has continued to be a need for a simplified construction that is simple, relatively quick and easy to assemble, and cost-effective to produce.

BRIEF SUMMARY OF THE INVENTION

The proposals of the present invention envision a simple construction embodying a plurality of muntins (e.g. grids) assembled with a sheet of light transmissive material (e.g glass), the sheet and muntins having therein aligned apertures through which Christmas-tree type fasteners are installed and within which such fasteners are fastened. A gasket-like strip is applied to the periphery of the transmissive material sheet and special staple-like members are employed to secure in place muntin strips at spaced locations corresponding to positions at which muntin strips are to be positioned. Staples are provided in or near the ends of the horizontal muntins to provide for holding the muntins in place when the framing stiles are applied. Thus, the sheet of light transmissive material and muntins are locked or secured together, and when the mounting frame is applied, there is provided a cost-effective closure, e.g., door or window.

OBJECTS AND FEATURES OF THE INVENTION

It is one general object of the invention to improve multi-light doors and windows.

It is another object of the invention to simplify manufacture of multi-light doors and windows.

It is still another object of the invention to improve the cost effectiveness of manufacturing multi-light doors and windows.

Accordingly, in accordance with one feature of the invention, a pane of light transmissive material is provided with a pattern of apertures therethrough, thus making provision for ready attachment of muntins.

In accordance with another feature of the invention, pairs of muntins are provided with mirror-image mating recesses thereby facilitating assembly with unitary fastening members.

In accordance with yet another feature of the invention, improved unitary fastening members are provided, thus facilitating assembly of the muntins.

in accordance with still another feature of the invention, a unitary sheet of light transmissive material is polywrapped prior to attachment of muntins, thus effectively masking the material partitions for painting, and thus simplifying painting preparation and reducing finishing costs.

In accordance with yet another feature of the invention, a gasket-like member is applied to the periphery of the sheet of light transmissive material, thus providing for a snug and dependable fit within a surrounding frame.

In accordance with still another feature of the invention, a plurality of staple-like members are positioned at spaced predetermined locations to engage portions of the muntins thereby to hold the muntins in position when peripheral frame members are attached.

In accordance with yet another feature of the invention, Christmas Tree type fasteners are installed in the muntins and sheet of transmissive material to cost-effectively provide for securing these members together.

These and other objects and features of the invention will be apparent from the following detailed description, by way of preferred examples, with reference to the drawing.

BRIEF DESCRIPTION OF THE DRAWING

FIG. 1 is a perspective view of a multi-panelled door according to the principles of the invention.

FIG. 2 is a detailed perspective view illustrating the interlocking of vertical and horizontal muntins of the door;

FIG. 3 is a view illustrating details of the improved Christmas tree fastener according to the invention;

DETAILED DESCRIPTION OF THE INVENTION

Figure 4:
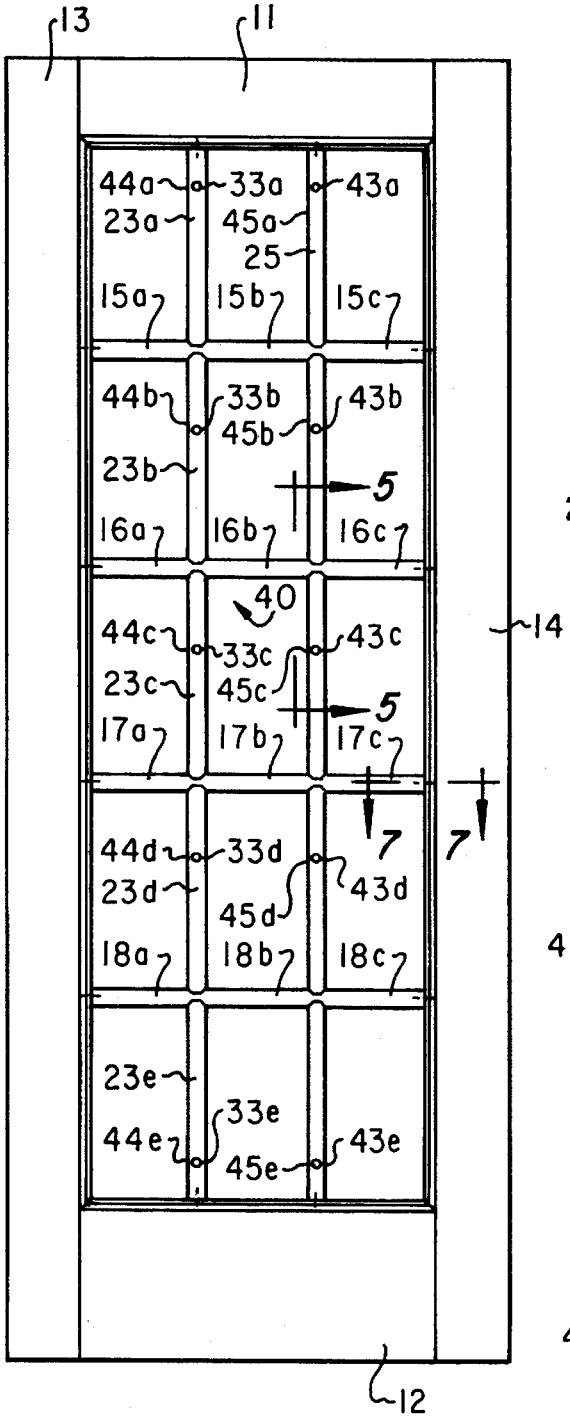
FIG. 4 is a front elevation view of the door of FIG. 1.

Now turning to the drawing, and more particularly FIG. 1 thereof, it will be seen to depict a door having a peripheral frame 10 comprising top rail 11, bottom rail 12, left hand stile 13 and right hand stile 14. Within frame 10 and attached thereto are rear horizontal muntins 15, 16, 17 and 18 which appear to be segmented respectively into sections 15*a*–15*c*, 16*a*–16*c*, 17*a*–17*c* and 18*a*–18*c* by rear vertical muntins 23 and 25. In complementary relationship thereto are front muntins 19, 20, 21 and 22 which appear to be segmented into sections 19*a*–19*c*, 20*a*–20*c*, 21*a*–21*c* and 22*a*–22*c* by vertical muntins 24 and 26. As will be observed from further inspection of FIG. 1, the vertical muntins 23–25 have continuous faces extending top to bottom. However for ease of description the indicated portions of these vertical muntins may be considered as sections 23*a*–23*e*,24*a*–24*e*, 25*a*–25*e* and 26*a*–26*e*. Thus, the upper left hand simulated pane of light transmissive material is seen to be bounded by horizontal muntin sections 15*a*/19*a*, 23*a*/24*a* and the indicated portions 28 and 29 of top rail 11 and left hand stile 13 respectively. The remaining simulated panes of light transmissive material are seen to be bounded by muntin, stile and top rail segments as shown.

Now turning to FIG. 2, a detailed view of the locking interrelationship of the horizontal and vertical muntins is shown. There, it will be seen, are vertical sections 24*a* and 24*b* of vertical muntin 24, together with sections 19*a* and 19*b* of horizontal muntin 19. Although for reasons of clarity and conciseness, only one typical muntin crossing is illustrated in FIG. 2, the principles therein illustrated are applicable to all the muntin crossings, both rear and front.

it will be noted that both the front and rear horizontal muntins are unitary members and extend continuously between the positions where their ends engage stiles 13 and 14. Correspondingly, both the rear and front vertical muntins are unitary members and extend continuously between the positions where their upper and lower ends engage top and bottom rails 11 and 12. However, at each point of crossing where horizontal and vertical muntins cross, mating notches such as notches 30*a* and 30*b* are formed thereby providing for convenient crossovers that also serve to lock the muntins to each other and to the unitary sheet of light transmissive material as is described below.

Further inspection of FIG. 2 reveals that surfaces forming notches 30*a* and 30*b* are of complementary geometry thus to provide for contiguous engagement when the muntins are assembled. Thus, looking at the top of muntin section 24*a* in FIG. 2, when muntin 24 is turned clockwise through 90 degrees and then brought into engagement with muntin 19, the complementary sections 30*a* and 30*b* mate together in surface contiguous relationship thus to form the composite as illustrated in FIG. 1.

Additional inspection of FIG. 2 reveals the presence of segmented "Christmas-tree" fasteners 33*a* and 33*b*. These fasteners are shown in greater detail as illustrated by fastener 33 in FIG. 3. Ends corresponding to end 34 (FIG. 3) are fitted into circular recesses that extend only part way into the vertical muntins 23–26 at spaced intervals, it being preferred that there be such a recess and fastener adjacent each simulated pane at about the locations shown in FIG. 4.

FIG. 3 depicts the fasteners (hereinafter, Christmas-tree fasteners) that preferably are used in practicing the invention. The principal axis x—x is essentially rectilinear, with the remaining parts of the fastener extending in an essentially radial geometry thereabout. The fasteners themselves are well known in the art and are preferably made of flexible plastic. Thus, the extending bell-shaped members 35 and associated washer-like extensions, or flutes, 36 are flexible so that when an end of the fastener is pressed into a cylindrically shaped recess (such as recess 37*a* or 37*b* of FIG. 2) that is slightly smaller in diameter than the outside diameter of the extensions 36, the outside edges of members 35 and extensions 36 bend toward the center of the fastener and thus present a correspondingly smaller effective diameter. However, when an attempt is made to withdraw the fastener, the longitudinal thrust results in an opposite effect whereby the ends of the extensions 36 attempt to return to their normal diameter, thus digging into the interior wall surface of the recess and strongly resisting withdrawal. For a more complete identification of the fasteners, reference is hereby made to part number F 2610-00-0078 as supplied by ITW Fastex Company of 195 Algonquin Road, Des Plains, Ill. 60016.

FIG. 4 depicts the door of FIG. 1 in a partly assembled state. Thus, it will be observed that FIG. 4 depicts the door with only the rear muntins in place against the unitary sheet 40 of light transmissive material. As mentioned earlier, the unitary sheet of light transmissive material completely fills the central part of the door, that is, the interior which is bounded by top rail 11, bottom rail 12, left side stile 13 and right side stile 14. Although the sheet is a single unitary member, the placement of the muntins creates the simulated appearance as if the door was constructed with a plurality of individual smaller panes.

Cylindrical recesses 33*a*–33*e* are provided in rear muntin 23, and similar recesses 43*a*–43*e* are provided in rear muntin 25, thus making provision for insertion of fasteners thereinto through corresponding apertures 44*a*–44*e* and 45*a*–45*e* extending through unitary light transmissive sheet 40. The apertures in sheet. 40 may be provided by any of a variety of ways known in the art such as by molding, cutting, drilling, abrading and the like prior to tempering. Although in accordance with the preferred method of practicing the invention, the apertures in sheet 40 are formed before tempering and before sheet 40 has been wrapped with one or more layers of thin plastic sheet material 50 (FIG. 5) such as for example a polyethylene wrap. In the preferred embodiment, the plastic sheet wrap over the locations of the apertures are pierced when fasteners 33 are inserted so as to facilitate the insertion of fasteners 33.

Figure 5:
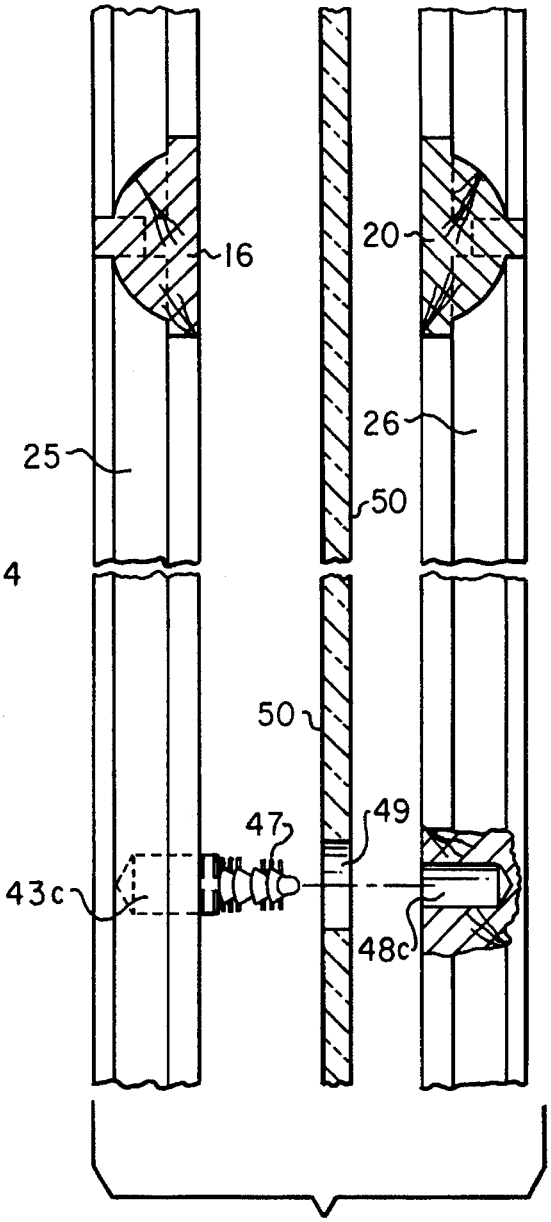
FIG. 5 is an exploded partial sectional view taken along the lines 5—5 of FIG. 4.

FIG. 5 is seen to be a partially cut-away and partly exploded section taken along the section lines 5—5 of FIG. 4. In addition, there is added to FIG. 5 a part of right front muntin 26 that is illustrated in FIG. 1 but which is omitted from FIG. 4 in order to add clarity of presentation. FIG. 5 shows one of the fasteners 33 in place within recess 43*c* with the outwardly projecting end 47 ready for insertion into recess 48*c* of front muntin 26 through aperture 49 through unitary light transmissive sheet 40 and plastic sheet wrap material 50.

Figure 6:
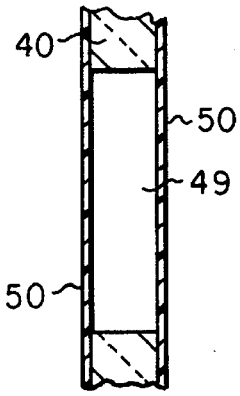
FIG. 6 is an enlarged detail view illustrating a representative one of the apertures within the light transmissive sheet of the door of FIG. 1.

FIG. 6 illustrates the foregoing aperture 49 in greater detail. There, it will be seen, are portions of unitary light transmissive sheet 40 adjacent aperture 49, as well as corresponding portions of plastic sheet wrap 50 that, as mentioned previously, is used to cover unitary sheet 40 to provide protection from scratching during construction as well as to provide for masking during any subsequent desired painting of the wooden portions of the door. As will be evident to one skilled in the art, after construction and painting, the plastic material may be removed as by cutting or tearing so as to clear the light transmissive simulated panels of the door.

Figure 7:
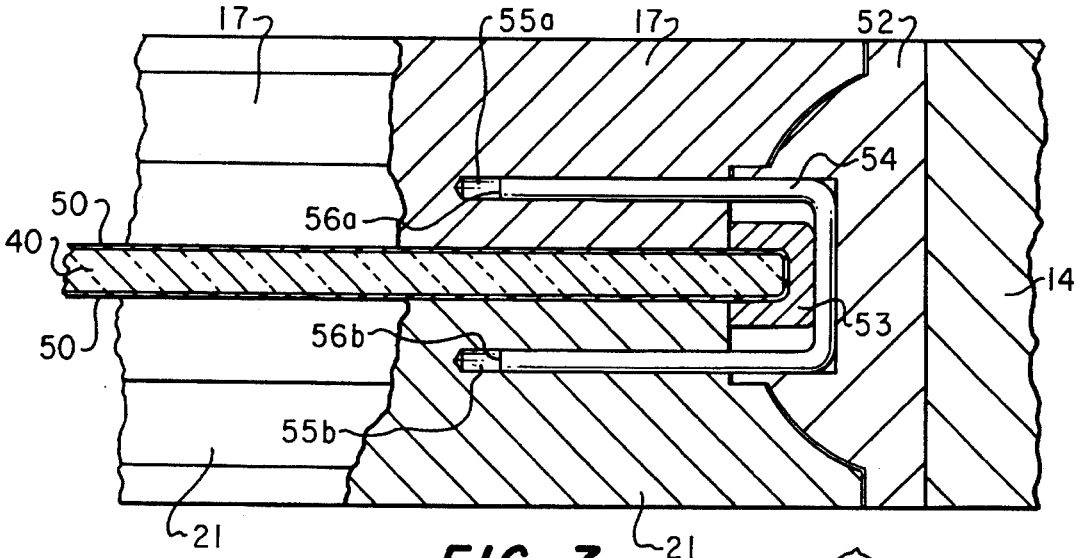
FIG. 7 is a partial sectional view taken along the lines 7—7 of FIG. 4 and illustrating the engagement of the muntins with position-retaining staples and the stiles of the door of FIGS. 1 and 4.

FIG. 7 illustrates additional features which have been found to facilitate construction of the door. Again, as with FIG. 5, there is included a part of front muntin 21 which is not shown in FIG. 4. Referring further to FIG. 7, there are seen a part of unitary sheet 40, plastic wrap 50, rear muntin 17, front muntin 21, right hand stile 14 and stile trim or profile 52. In addition, there are seen a part of a gasket 53 which extends about the entire periphery of sheet 40 and is attached thereto as by press fit, gluing or the like. Also shown is generally u-shaped staple 54 that may be attached to gasket 53 or positioned with stile trim or profile 52. One such staple is provided for each pair of horizontal front/back muntins (e.g., muntins 17/21, 15/19, 16/20 18/22) and for each pair of vertical muntins (e.g., muntins 23/24 and 25/26. The staples engage corresponding recesses to hold the muntins in place while stiles and rails are pressed into place around the periphery of sheet 40 and gasket 53. Thus, there is provided one such staple at each location around the periphery of glass sheet 40 where a pair of horizontal and vertical front/back muntins abut adjacent surfaces of the stiles and rails.

Further reference to FIG. 7 reveals that the staple-engaging recesses **55*a* and 55*b* within the muntins are shown as being slightly longer than the projecting ends 56*a* and 56*b* of staple 54 thus providing for manufacturing tolerances. However, it is not necessary that such be the case, for the recesses could readily be made the same length so that the projecting ends of the staples would entirely fill the recesses Now turning to FIG. 8, it will be seen to illustrate further the interrelationships of the muntins, light transmissive sheet, gasket, staples and stiles/rails. Although the illustration of FIG. 8 will be described in terms of the association of the aforementioned parts with right hand stile 14, it will be evident that the principles also apply to the left hand stile 13, top rail 11 and bottom rail 12**.

Figure 8:
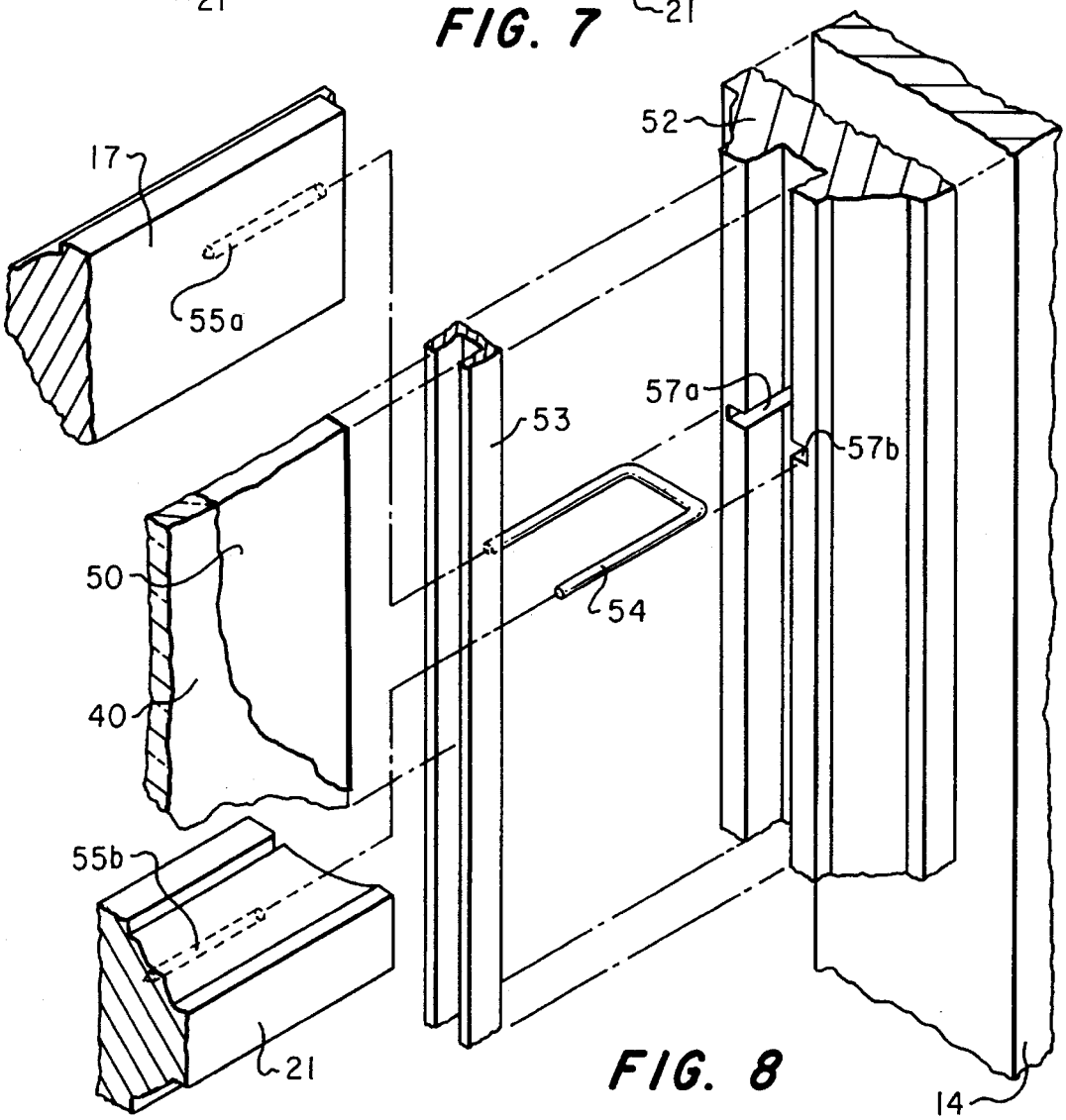
FIG. 8 is an exploded view illustrating the interrelationships of the light transmissive member, peripheral gasket, muntins, staples and stiles of the door of FIGS. 1 and 4.

FIG. 8 shows parts in exploded form, and trim 52 is shown separated from stile member 14 to aid in illustration. However, it will be evident to those skilled in the art that trim 52 and stile member 14 could be (and preferably would be) made as one unitary member.

As mentioned above, the staples such as staple 54 could be attached or otherwise held in place on the gasket 53. Alternatively, they could be press fitted into or otherwise positioned within notches (e.g., preformed or formed by force fit) such as notch **57*a*/57*b* provided at the desired predetermined locations in trim member 52**.

Figure 9:
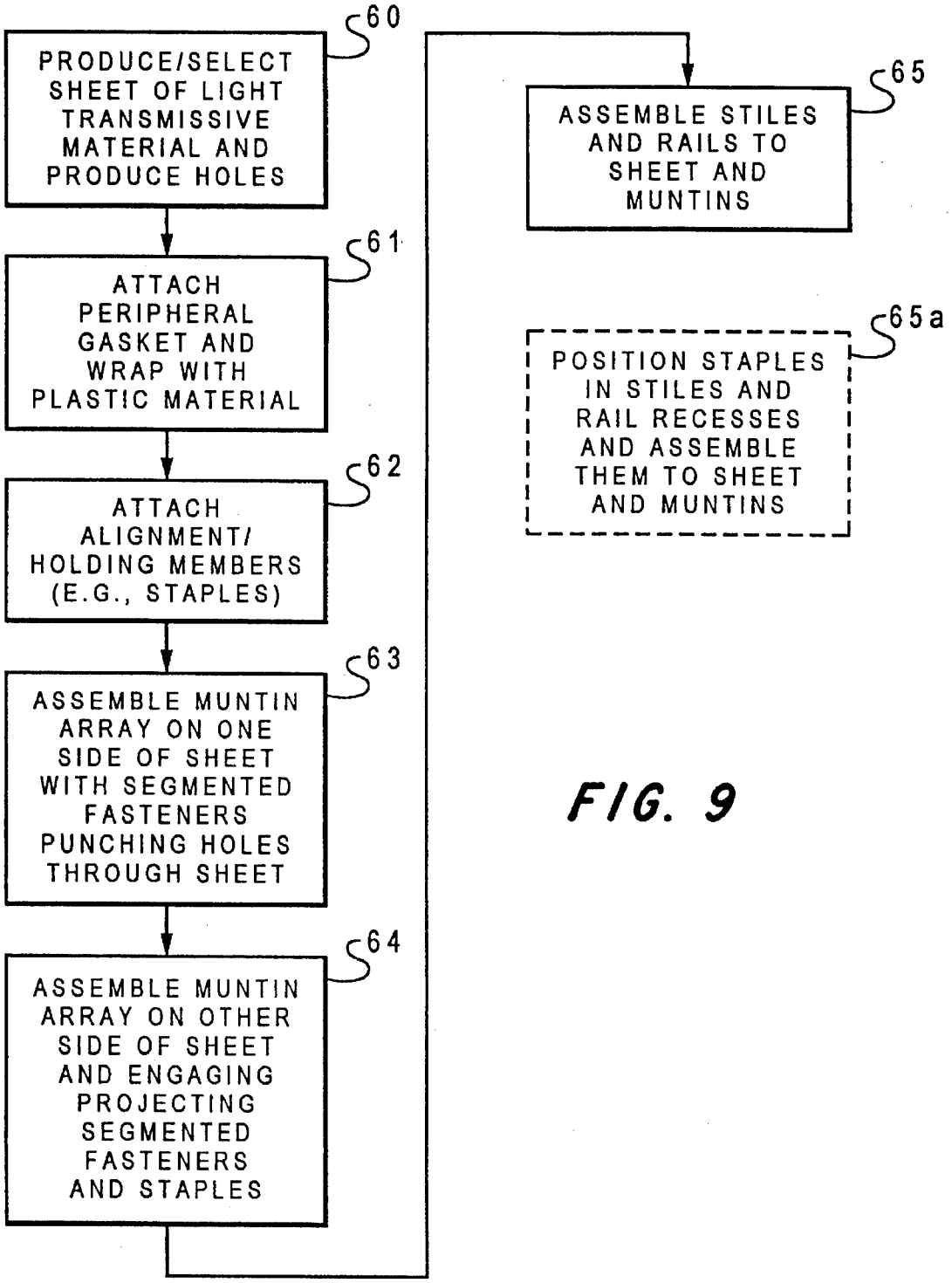
FIG. 9 is a flow diagram of the steps in the method of assembly of a door according to the invention.

FIG. 9 illustrates steps in the manufacture and assembly of a door, window or similar product while practicing the foregoing principles of the invention. There, it will be observed are shown steps 60 of selecting or otherwise producing the above-described sheet 40 of light transmissive material and producing apertures in the sheet. Such sheet may be produced initially with the aforementioned apertures therethrough or subsequently provided with such apertures. Next, the above-described peripheral gasket is attached and sheet 40 is wrapped with a thin layer of plastic protective material as represented by step 61.

Step 62 illustrates attachment of the alignment/holding members, e.g., staples 54 to the periphery of the light transmissive sheet 40 as described above. Such attachment may be made using any of a variety of well-known techniques such as by a force fit, the use of glue, rubberized cement or the like which will not be adversely affected by the remaining steps of manufacture and the environment in which the product is to be used.

Steps 63 and 64 illustrate assembly of the muntins to the front and rear of the plastic wrapped light transmissive sheet 40 with the use of the previously described segmented fasteners; and step 65 illustrates the assembly (preferably press fitting) of the stiles and top/bottom rails to the remaining parts. In this connection, it should be noted that steps 62–65 contemplate assembly with the aforementioned staples 54 being attached or held in place on the gasket 53. However, in order to illustrate the alternative construction in which the staples 53 are held in place within recesses such as recess **57*a*/57*b* (FIG. 8), alternative step 65*a*** is also shown.

It will now be evident to those skilled in the art that there has been described herein an improved multi-panelled door, window or the like which simplifies manufacture and reduces cost.

Although the invention hereof has been described by way of example of a preferred embodiment, it will be evident that other adaptations and modifications can be employed without departing from the spirit and scope thereof. For example, translucent sheet material could be wholly or partially employed, or two or more unitary sheets of light transmissive material could be used and segmented into simulated separate panes using the foregoing principles. Moreover, if parts such as the muntins, stiles and rails were pre-painted, and if care were employed in handling the unitary sheets, wrapping with the plastic sheet material could be eliminated. In addition, it will be recognized that the order in which some of the steps of manufacture are conducted could readily be changed.

The terms and expressions employed herein have been used as terms of description and not of limitation; and thus, there is no intent of excluding equivalents, but on the contrary it is intended to cover any and all equivalents that may be employed without departing from the spirit and scope of the invention.

What is claimed is:

1. A multi-panelled light transmissive member comprising:

(a) a sheet of light transmissive material having a plurality of holes therethrough;

(b) a peripheral wood frame;

(c) mounting means for mounting said sheet of light transmissive material within said peripheral wood frame;

(d) a plurality of wood muntins mounted on opposite sides of said sheet of light transmissive material in complementary disposition to seemingly segment said sheet of light transmissive material into apparent sub-panels; and (e) a plurality of Christmas-tree fasteners positioned within said holes and engaging said wood muntins thereby to lock said wood muntins to said light transmissive material.

2. A light transmissive member according to claim 1 wherein said Christmas-tree fasteners are elongated tubes each having a first terminus at one end and another terminus at another end.

3. A light transmissive member according to claim 2 wherein said Christmas-tree fasteners are substantially cylindrical one piece members having a central collar portion of a first predetermined diameter, a first cylindrical extension of diameter less than said first predetermined diameter and a plurality of resilient projecting flutes.

4. A light transmissive member according to claim 2 wherein said wood muntins each include a recess receiving and engaging in locking relationship one of said termini.

5. A light transmissive member according to claim 1 in which said light transmissive member includes a single sheet of light transmissive material only.

6. A light transmissive member according to claim 1 further including a plurality of staples adjoined to said sheet of light transmissive material at spaced positions adjacent the perimeter thereof.

7. A light transmissive member according to claim 1 further including a gasket adjoined to the periphery of said sheet of light transmissive material.

8. A light transmissive member according to claim 7 further including a plurality of staples attached to said gasket at spaced positions thereon.

9. A light transmissive member according to claim 7 further including a plurality of staples positioned at predetermined spaced intervals adjacent to said gasket for engaging ends of said wood muntins.

10. A light transmissive member according to claim 1 in which said light transmissive material is glass.

11. A light transmissive member according to claim 1 in which said light transmissive member is a door.

12. A light transmissive member according to claim 1 in which said light transmissive member is a window.

13. A light transmissive member according to claim 1 in which said light transmissive material is transparent.

14. A light transmissive member according to claim 1 in which said light transmissive material is translucent.

15. A multi-panelled door comprising:

(a) a sheet of light transmissive material having a plurality of holes therethrough;

(b) a peripheral wood frame;

(c) mounting means for mounting said sheet of light transmissive material within said peripheral wood frame;

(d) a plurality of wood muntins mounted on opposite sides of said sheet of light transmissive material in complementary disposition to seemingly segment said sheet of light transmissive material into apparent sub-panels;

(e) a plurality of fasteners positioned within said holes and engaging said wood muntins thereby to lock said muntins to said light transmissive material; and (f) a plurality of staples adjacent the periphery of said sheet at predetermined spaced intervals and engaging ends of said wood muntins to retain said ends of said muntins at said predetermined spaced intervals.

16. A multi-panelled door according to claim 15 further including a second peripheral wood frame extending around said periphery of said sheet and including a recess for engaging each of said staples.

17. A multi-panelled door comprising:

(a) a sheet of glass having a plurality of holes therethrough and a gasket joined to said sheet about the periphery thereof;

(b) a peripheral wood frame;

(c) mounting means including said gasket for mounting said sheet of light transmissive material within said peripheral wood frame;

(d) a plurality of wood muntins mounted on opposite sides of said sheet of light transmissive material in complementary disposition to seemingly segment said sheet of light transmissive material into apparent sub-panels;

(e) a plurality of fasteners positioned within said holes and engaging said wood muntins thereby to lock said muntins to said light transmissive material; and (f) a plurality of staples affixed to said gasket at predetermined spaced intervals and engaging ends of said wood muntins to retain said ends of said muntins at said predetermined spaced intervals.

18. A multi-panelled door according to claim 17 further including a second peripheral wood frame extending around said periphery of said sheet and including a recess for each of said staples.

19. A multi-panelled window comprising:

(a) a single sheet of light transmissive material having a plurality of holes therethrough;

(b) a peripheral wood frame;

(c) mounting means for mounting said light transmissive material within said peripheral wood frame;

(d) a plurality of wooden muntin pairs fastened to opposite sides of said sheet of light transmissive material in complementary disposition to seemingly segment said sheet of light transmissive material into apparent sub-panels; and (e) a plurality of Christmas tree fasteners positioned within said holes and engaging said wooden muntins thereby to lock said muntins to said light transmissive material.

20. A method of making a multi-panelled light transmissive member comprising:

(1) selecting a unitary member of light transmissive material;

(2) providing apertures through said member at predetermined spaced apart locations;

(3) covering said member with a separate and discrete sheet of plastic material;

(4) locating staples at spaced intervals adjacent the periphery of said member;

(5) providing pairs of horizontal and vertical wooden muntins;

(6) affixing said pairs of horizontal and vertical wooden muntins to each other and to said unitary member by fasteners extending through said apertures; and (7) engaging ends of said wooden muntins with said staples thereby to maintain said ends in predetermined positions.

21. A method according to claim 20 further including a step of affixing to the periphery of said member a wooden frame for said member.

22. A method according to claim 20 further including a step of mounting a gasket on the periphery of said unitary member.

23. A method according to claim 22 including affixing said staples to said gasket.

24. A method according to claim 22 further including a step of affixing to said gasket a wooden frame for said member.

* * * * *